United States Patent [19]

Novotny

[11] 4,053,189

[45] Oct. 11, 1977

[54] TURBINE CONSTRUCTION

[75] Inventor: Rudolph J. Novotny, Stuart, Fla.

[73] Assignee: United Technologies Corporation, Hartford, Conn.

[21] Appl. No.: 697,096

[22] Filed: June 17, 1976

[51] Int. Cl.[2] ..... F16C 35/00

[52] U.S. Cl. ..... 308/26; 308/189 R

[58] Field of Search ..... 308/26, 15, 72, 189 R; 415/180; 184/6.11

[56] References Cited

U.S. PATENT DOCUMENTS

| | | | |
|---|---|---|---|
| 3,048,452 | 8/1962 | Addie | 308/26 |
| 3,756,672 | 9/1923 | Aibner | 308/26 |

*Primary Examiner*—Philip Goodman
*Assistant Examiner*—Gene A. Church
*Attorney, Agent, or Firm*—Jack N. McCarthy

[57] ABSTRACT

A power plant is shown having a turbine power unit with a gas producer for directing gases into the unit while an exhaust duct delivers gas from the unit and a drive shaft extends from the unit for delivering power. The turbine power unit includes a turbine rotor mounted in bearing assemblies in its front and rear end. The rear assembly is supported by rigid struts while the front bearing assembly is supported by the first stage vanes and an interconnecting specially constructed diaphragm with heat shields. The outer ends of the vanes are fixed to a cantilevered ring fixed to the turbine casing while the inner circumference of the diaphragm has a large interference fit with a cylindrical surface on the front bearing assembly housing.

10 Claims, 3 Drawing Figures

TURBINE CONSTRUCTION

BACKGROUND OF THE INVENTION

This invention relates to a power turbine and its means for reducing high relative thermal deflections and stresses during operation. U.S. Pat. No. 3,048,452 discloses a turbine which includes improvements in a bearing support for a turbine shaft which is tolerant of relative thermal expansion of the parts.

SUMMARY OF THE INVENTION

A primary object of the present invention is to provide a power turbine construction which can accommodate high relative thermal deflections and stresses obtained between off and on operation, while still retaining a stiff (high spring rate) bearing support.

It is an object of this invention to support the forward bearing assembly by the outer casing to the inlet vanes and a specially constructed diaphragm having heat shields and extremely tight I.D. fit to bearing compartment which is necessary to minimize transient thermal stress while retaining a stiff bearing support. In addition the joining I.D. plane of the individual vanes is perpendicular to the engine centerline which provides a high degree of coulomb damping.

It is a further object of this invention to provide a cantilevered ring member fixed to the turbine casing at one end while each vane of the first stage is connected to said cantilevered member by a single bolt extending radially inwardly through the ring into the blade. The cantilevered member is designed to respond to temperature change the same as the vanes, which minimizes the stresses from relative thermal growths.

DESCRIPTION OF THE PREFERRED EMBODIMENTS

Figure 1:
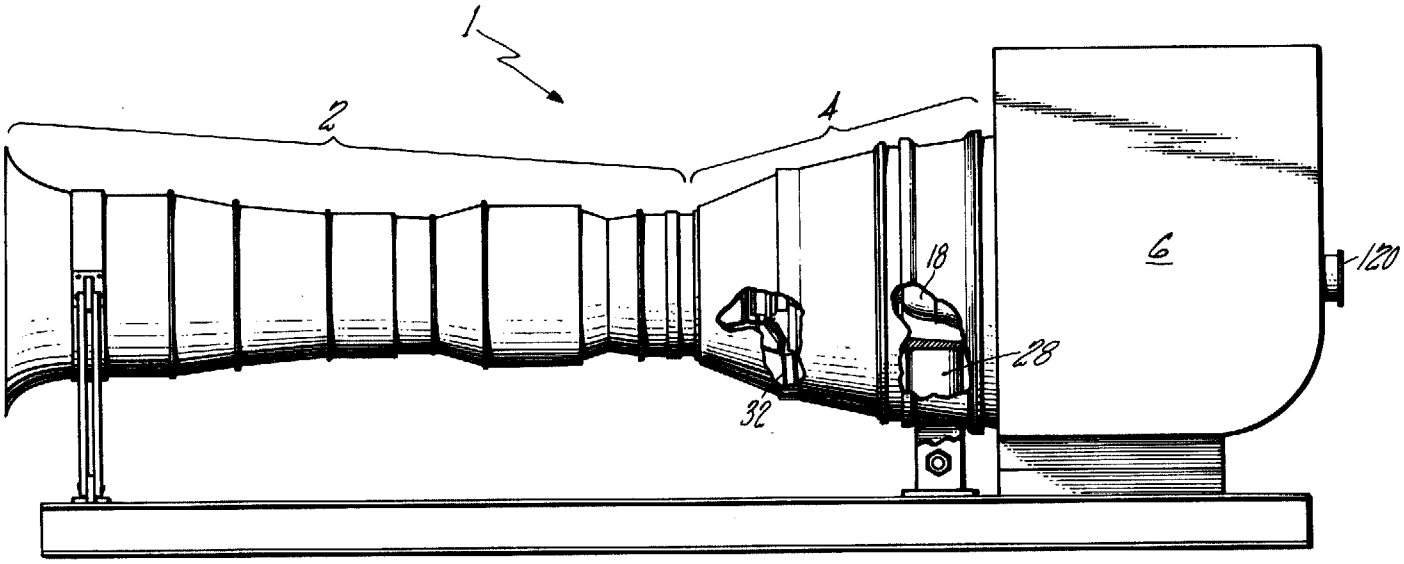
FIG. 1 is a longitudinal view of a power plant broken away showing portions of the turbine power unit.
Figure 2:
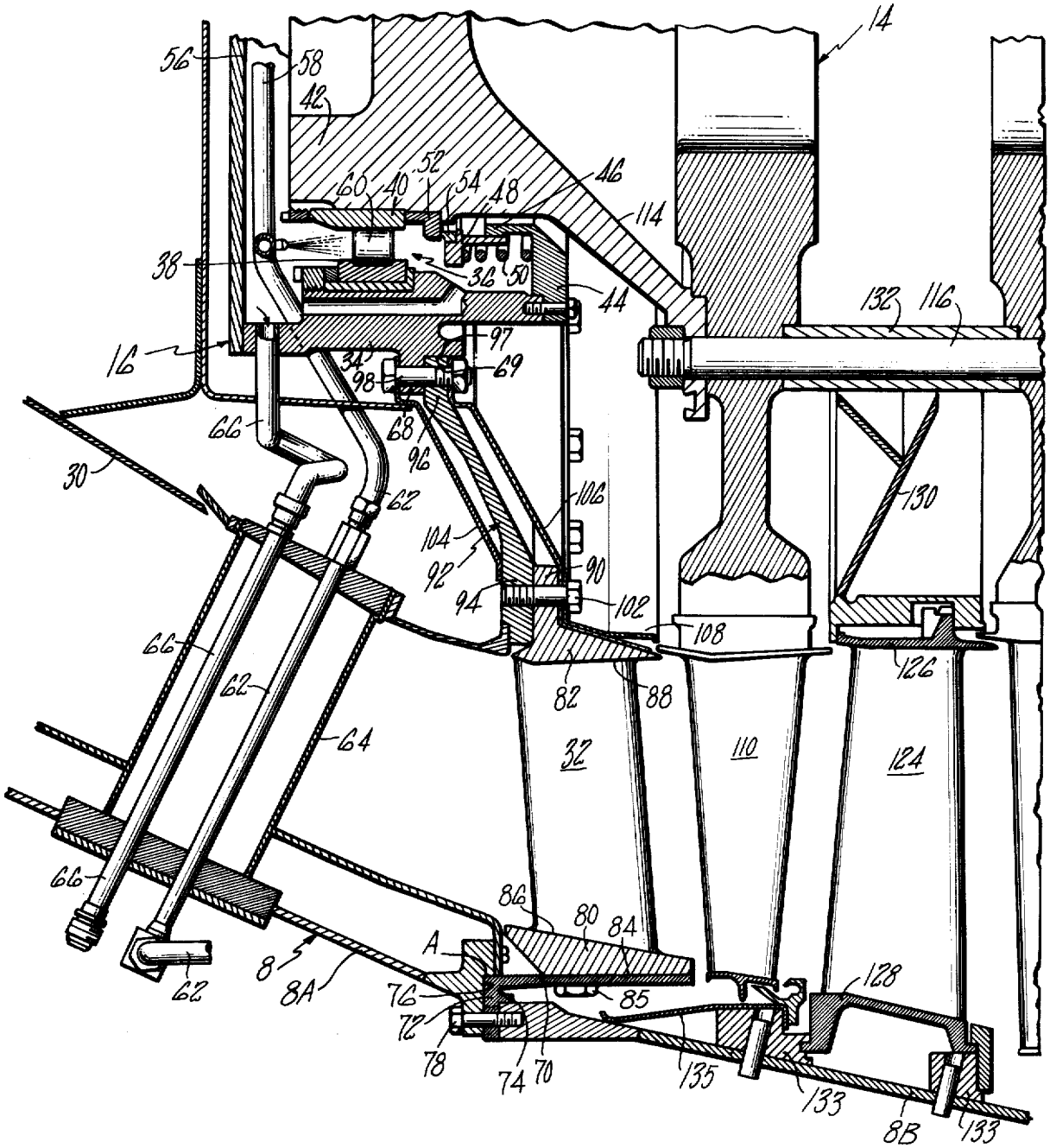
FIG. 2 is an enlarged view of the fragmentary section shown in FIG. 1 at the forward part of the turbine power unit.
Figure 3:
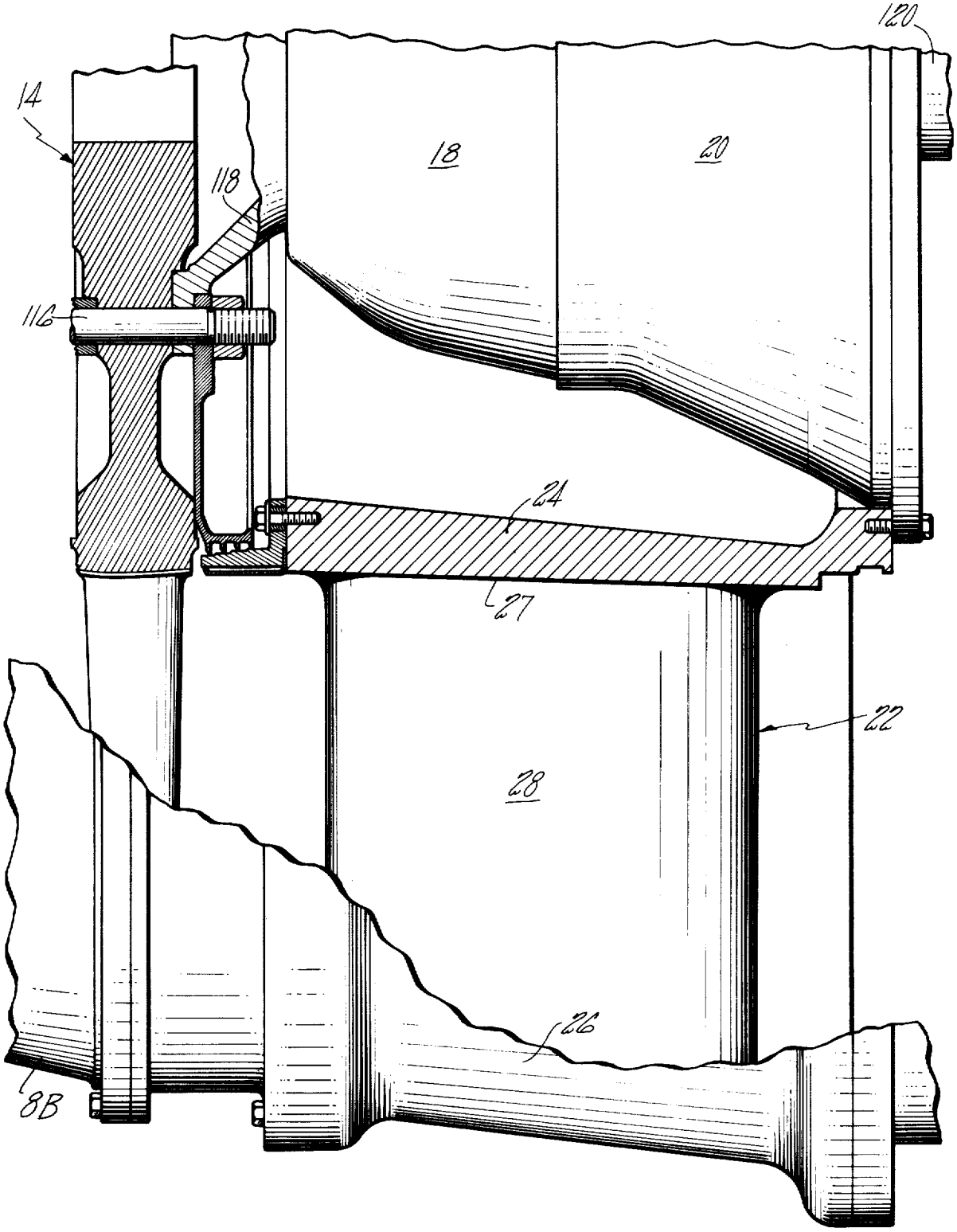
FIG. 3 is an enlarged view of the fragmentary section shown in FIG. 1 at the rearward part of the turbine power unit.

In FIG. 1 the power plant 1 includes a gas producer 2, a turbine power unit 4 and an exhaust duct 6. While the gas producer 2 and the exhaust duct 6 can be of any desired construction, the turbine power unit is constructed as follows: an outer housing 8 is bolted at its forward end to the rear of a gas producer 2, and at its rearward end to an exhaust duct 6. The rotor assembly 14 is mounted for rotation within the turbine power unit between a front bearing assembly 16 and a rear bearing assembly mounted in a housing 18. The rear bearing assembly housing 18 is supported by the outer housing 8 through a conical member 20 and an annular turbine outlet assembly 22. The annular turbine outlet assembly 22 includes an inner annular member 24 and an outer annular member 26, forming an annular outlet passageway 27, with a plurality of struts 28 located therebetween. Annular member 26 forms the rearward part of the outer housing 8 and contains a rearward annular flange for connection to the exhaust duct 6. The conical member 20 extends from the rearward part of the inner annular member 24 to the center of the rear bearing assembly housing 18.

The forward part of the turbine power unit 4 has an annular inlet passageway 30 for receiving the exhaust flow from the gas producer 2. Passageway 30 extends to inlet vanes 32. The connection of the rearward end of passageway 30 will be hereinafter described.

The front bearing assembly 16 comprises a housing 34 having a bearing means 36 mounted therein. The bearing means 36 comprises an outer ring 38 having a race on its inner surface and an inner ring 40 with a race on its outer surface with rollers 60 mounted therebetween. Any bearing assembly desired meeting the temperature and speed requirements can be used. The outer ring 38 of the bearing is fixed within the housing while the inner ring 40 is fixed to a short shaft 42 extending forwardly of the rotor assembly 14 into the housing 34. The rearward part of the housing 34 has an annular end plate fixed thereon with a forwardly projecting cylindrical member 46 which projects around the short shaft 42 towards the inner ring 40. A cylindrical-like member 48 is slidably mounted on the forwardly projecting cylindrical member 46 with a spring member 50 biasing the cylindrical member 48 forwardly to form a sealing engagement between a seal member 52 on said shaft 42 and a seal member 54 on the forward part of said cylindrical member 48.

To cool said front bearing assembly 16, a front cover plate 56 is placed over the open forward end of the housing to completely enclose the bearing assembly 16 and an oil cooling manifold 58 is positioned forwardly of the bearing assembly 16 with nozzles for directing a coolant flow against the rollers 60 of the bearing assembly 16. It can be seen that oil is directed from a source to the manifold 58 through conduit means 62 which extends through a strut 64 in inlet passageway 30. Oil from within the enclosed compartment flows out the conduit 66. Housing 34 has a radial flange 68 therearound extending outwardly with a cylindrical surface 69 rearwardly thereof for mounting said front bearing assembly 16 in a manner to be hereinafter described.

Inlet vanes 32 are connected at their outer ends to a cantilevered annular outer vane support member 70. The forward end of the outer vane support member 70 has an outwardly extending annular radial flange 72. The flange member 72 has a rearwardly extending portion 74 thereon having an outwardly facing surface. The outer vane support member 70 has its forward end positioned in a recessed portion 76 on an enlarged rearward end of the front section 8A of the outer housing 8 so that the inner surface of the front edge of the annular outer vane support member 70 engages the outwardly facing annular surface of the recess portion 76 at A. The forward portion of the midsection 8B of the outer housing 8 has a cylindrical member positioned against the rearward part of flange member 72 with its inner circumference engaging the outer surface of member 74 at B. The circumferential surface engagements at A and B are interference fits so that annular contact is maintained throughout the running of the engine. The flange member 72 is scalloped between the bolts 78 which fix the rear part of front section 8A to the front part of the midsection 8B, squeezing the flange member 72 therebetween. This scalloping of the flange lessens the hoop strength. It can be seen that the rear end of the outer wall of the annular inlet passageway 30 is flanged outwardly and fixedly connected to the rear end of the front section 8A.

The inlet vanes 32 are individually formed with each vane having an outer platform member 80 and an inner platform member 82. When mounted the outer platform members 80 form a segmented ring with an outer surface which fits the inner surface 84 of the outer vane support member 70 and has an inner surface 86 which forms an extension of the outer wall of the inlet passageway 30. A single bolt 85 extends through the member 70 radially into each vane. The inner platforms 82 when placed adjacent each other form a surface 88 which is an extension of the inner surface of the inlet passageway 30. Each inner platform has a flange 90 extending inwardly therefrom. All of said flanges 90 form an annular flange which lies on a plane perpendicular to the axis of the rotor assembly 14. A diaphragm 92 of a performed conical shape has an outer annular end portion 94 which mates with the forward surface of flanges 90 and an inner annular end portion 96 which mates with the rearward surface of the housing flange 68. The inner surface 97 of the inner annular end portion 96 has a large interference fit with the cylindrical surface 69 to insure contact at all operating conditions. The interference fit in a construction built had a preload on the diaphragm to 0.2% of yield. The diaphragm is made conical to obtain proper spring rate and prevent "oil canning". A plurality of bolts 98 fix the flange 68 to the inner portion 96 of the diaphragm 92 and each blade has its flange 90 bolted to the outer part 94 of the diaphragm 92 by a single bolt 102. It can be seen that the rear end of the inner wall of the annular inlet passageway is flanged inwardly and fixably connected to the end portion 94 of the diaphragm 92.

A heat shield 104 covers the forward face of diaphragm 92 and a heat shield 106 covers the rearward face thereof. Heat shield 104 is formed having a conical section formed of sheet metal spaced from said diaphragm and being fixed at its inner circumference to flange 68 by bolts 98 with its outer circumference being biased against the outer end portion 94 of diaphragm 92. Heat shield member 106 is formed having a conical section spaced from the diaphragm 92 with its inner end held against the inner end portion 96 of the diaphragm 92 by the bolts 98. The outer end section of the heat shield 106 comforms with the rear shape of the flange 90 and inner surface of the inner platform member 82. This extension of the heat shield down the inner part of the inner platform member helps seal any space between adjoining vanes. This outer end of the heat shield 106 is fixed to the vanes 32 by bolts 102. A seal member 108 is also fixed in place by bolts 102 for sealing with the platform of the adjacent first stage blades. The heat shields 104 and 106 on both sides of the diaphragm 92 help provide as smooth as thermal gradient as possible. Heat shield 104 protects that side of the diaphragm by preventing high temperature gases from reaching the diaphragm while heat shield 106 keeps the cooler gases from reaching the opposite side of the diaphragm 92.

The rotor assembly 14 can be of conventional construction with the rotor disc of the first stage blades fixed to a flange 114 extending rearwardly from the short shaft 42 of the rotor assembly 14. The rotor assembly 14 consists of a plurality of rotor discs and blades spaced apart and held together by through-bolts 116 (see U.S. Pat. No. 3,048,452). The last stage of the rotor assembly 14 is connected to a flange member 118 which has a shaft located at its rear end and which is rotatably mounted in the rear bearing assembly. The shaft rotatably mounted in the rear bearing assembly has an extension shaft 120 which extends through the exhaust duct 6 to the exterior of the power plant for use in driving any device desired.

The rotor assembly 14 also includes stationary vanes 124 located between each of the adjacent rotor discs and blades. The vanes are fixed to inner and outer shroud members 126 and 128 providing a flow path through the turbine unit. The shroud members 128 are fixed to members 133 located on the inner surface of the midsection 8B of the outer housing 8. Seal means 130 extends inwardly from the inner ends of the vanes 124 to form a sealing engagement with cylindrical spacers 132. Seal means 135 extends forwardly of the forward member 133 to seal with the inner circumference of midsection 8B radially outwardly from the vane support 70.

Diaphragm 92 is contoured, heat shielded and prestressed outwardly at the inner diameter to be able to accept the large thermal gradient from the inner diameter to its outer diameter. During operation of one configuration build, the outer diameter near the flow path reaches approximately 1300° F. and the internal diameter is approximately 300° F. making a temperature gradient of 1000° F. across a length of approximately nine inches of radius.

Each individual vane 32 is held at each end by a single bolt. The outer end is bolted by a radially extending bolt 85 to the cylindrical support member 70. A large thermal gradient also exists from the aft end of the support 70 to its forward end which is connected to the housing 8. This member has been made cylindrical to accept this gradient. The transient temperatures of the configuration built are approximately 970° at the aft free end to 300° F. at the forward connected end receiving a gradient of 670° F. across a length of six inches, the length of the support 70. In conclusion, the design marries two opposing requirements, the bearing support diaphragm must be very stiff because of rotor critical RPM requirements and at the same time accept the large thermal growth caused by the large thermal gradients.

I claim:

1. A turbine power assembly comprising a case, a rotor assembly mounted for rotation therein, said rotor assembly having a forwardly extending shaft means, a bearing assembly for supporting said shaft means, means mounting said bearing assembly comprising a diaphragm positioned therearound, said diaphragm having an inner periphery and an outer periphery, the inner periphery of said diaphragm being fixed to said bearing assembly, an annular passageway located between said bearing assembly and case, vanes in said passageway, the outer periphery of said diaphragm being connected to the inner ends of said vanes, a cylindrical member, said cylindrical member having one end connected to the case, said vanes having their outer ends fixed to said cylindrical member.

2. A combination as set forth in claim 1 wherein the inner end of each vane has a flange extending inwardly therefrom, adjacent flanges of adjacent vanes forming an annular ring, the outer periphery of said diaphragm having an annular face thereon, said annular face mating with said annular ring.

3. A combination as set forth in claim 2 wherein each flange of each vane has a bolt fixing it against said annular face on said diaphragm.

4. A combination as set forth in claim 1 wherein said case is formed having two sections, said cylindrical member having a radially outwardly extending flange on one end, said radially extending flange being fixed between the two sections of said case.

5. A combination as set forth in claim 4 wherein the rearward end of one section of said case has a first recessed portion with a first outwardly facing cylindrical surface, the end of said cylindrical member having the radially extending flange having an interference fit within said first cylindrical surface, the radially extending flange of said cylindrical member having a second recessed portion with a second outwardly facing cylindrical surface, the free end of the other adjacent section of said case having an interference fit within said second cylindrical surface.

6. A combination as set forth in claim 1 wherein said bearing assembly has a radially outwardly extending flange means, said bearing assembly having an outwardly facing cylindrical surface adjacent said flange means, the inner periphery of said diaphragm having an inwardly facing cylindrical surface, said inwardly facing cylindrical surface having an interference fit with the outwardly facing cylindrical surface.

7. A combination as set forth in claim 6 wherein said interference fit is made to preload the diaphragm to a very high value.

8. A combination as set forth in claim 1 wherein a heat shield means extends between said bearing assembly and the inner ends of the vanes for protecting said diaphragm.

9. A combination as set forth in claim 8 wherein said heat shield means comprises a heat shield plate on each side of said diaphragm.

10. A combination as set forth in claim 8 wherein said heat shield means includes seal means at its outer end for sealing between the inner ends of the vanes.

* * * * *